US007828149B2

(12) United States Patent
Kalvelage et al.

(10) Patent No.: US 7,828,149 B2
(45) Date of Patent: Nov. 9, 2010

(54) SEALED BLISTER ASSEMBLY

(75) Inventors: John D. Kalvelage, Conyers, GA (US); Ian Salditch, Cockeysville, MD (US); Galen Nickey, Lutherville, MD (US)

(73) Assignee: Multi-Comp, Inc., Hunt Valley, MD (US)

( * ) Notice: Subject to any disclaimer, the term of this patent is extended or adjusted under 35 U.S.C. 154(b) by 337 days.

(21) Appl. No.: 11/751,663

(22) Filed: May 22, 2007

(65) Prior Publication Data

US 2008/0289989 A1 Nov. 27, 2008

(51) Int. Cl.
*B65D 83/04* (2006.01)

(52) U.S. Cl. ..... 206/538; 206/532; 206/534

(58) Field of Classification Search ..... 206/461, 206/462, 464, 465, 467, 469, 470, 471, 528, 206/531, 532, 534.1, 538, 539; 220/359.1, 220/359.2, 524

See application file for complete search history.

(56) References Cited

U.S. PATENT DOCUMENTS 3,111,220 A 11/1963 Bostrom
3,311,229 A * 3/1967 Troll et al. ..... 206/461
3,346,099 A 10/1967 Thomas et al.
3,388,827 A 6/1968 Thanhauser et al.
3,450,252 A 6/1969 Hallerbach
3,844,408 A 10/1974 Relyea
3,924,748 A 12/1975 Braverman
4,163,496 A 8/1979 Dogliotti
4,294,361 A * 10/1981 Margulies et al. ..... 206/532
4,416,375 A 11/1983 Braverman et al.
4,427,705 A 1/1984 Wyslotsky et al.
4,609,121 A 9/1986 Ludwig
4,693,371 A 9/1987 Malpass
5,033,616 A * 7/1991 Wyser ..... 206/704
5,074,416 A 12/1991 Hustad
5,129,512 A 7/1992 Garwood
5,293,997 A 3/1994 Hustad et al.
5,339,973 A 8/1994 Edwards et al.
5,377,860 A 1/1995 Littlejohn et al.
5,398,908 A 3/1995 Kienle
5,549,204 A * 8/1996 Toren ..... 206/539
5,582,317 A 12/1996 Wermund
5,602,612 A 2/1997 Angeli et al.
5,788,079 A 8/1998 Bouthiette
5,791,478 A 8/1998 Kalvelage et al.
5,803,248 A 9/1998 Cox
5,860,549 A 1/1999 Allers et al.
5,878,888 A * 3/1999 Faughey et al. ..... 206/530
6,021,623 A 2/2000 Bouthiette
6,023,916 A 2/2000 Bouthiette
6,039,495 A 3/2000 Zimmerman et al.
6,364,115 B1 * 4/2002 Casanova et al. ..... 206/471
6,592,978 B1 7/2003 Miller et al.

(Continued)

*Primary Examiner*—Ehud Gartenberg
*Assistant Examiner*—Ernesto A Grano
(74) *Attorney, Agent, or Firm*—Thomas & Karceski, P.C.

(57) ABSTRACT

A sealed blister assembly is made tip of a blister sheet, a lid sheet, and a label sheet. The plastic sheet and plastic lid are joined together to form a substantially impermeable seal. The seal is formed by engagement of an undercut in the plastic sheet and a shoulder in the plastic lid. A plastic sheet and/or plastic lid are made from a polymer such as low density polyethylene to obtain the impermeable seal. The label sheet is secured directly to the blister and lid sheets.

9 Claims, 7 Drawing Sheets

U.S. PATENT DOCUMENTS 6,681,935 B1 * 1/2004 Lewis ..... 206/534
6,802,422 B2 * 10/2004 Kalvelage et al. ..... 206/538
2002/0162768 A1 * 11/2002 Bolnick et al. ..... 206/532
2004/0206653 A1 * 10/2004 Filion ..... 206/461
2006/0144749 A1 7/2006 Arnold et al.

* cited by examiner

SEALED BLISTER ASSEMBLY

FIELD OF THE INVENTION

This invention relates to a sealed blister assembly wherein a blister sheet and lid sheet are joined together to form an impermeable seal and a label sheet is joined to both the blister sheet and lids. The label sheet provides a tamper-indicating mechanism and may include printed indicia.

BACKGROUND OF THE INVENTION

Blister packages have been well known for many years. They have been used for many purposes in different types of packaging applications. In some inexpensive and undemanding applications, items can be packaged in plastic blisters with simple cardboard backing. The blister sheet and backing may or may not be adhered together.

Pharmaceutical products are often placed in tightly sealed blister packs. For safety, sanitation, and medication efficacy reasons, there is the need for a seal between a blister sheet and lid. For instance, the seal is required to keep medications fresh and unspoiled. This is accomplished conventionally by a heat seal or adhesive between the blister sheet and lid. It is also known to include a paper layer that ruptures in order to allow access to the medication. However, many consumers dislike rupture layers, as they can be difficult to operate. Blister packages with rupture layers are also aesthetically displeasing in many cases, and prevent multiple pills or medications types from being packaged in a single blister.

Problems with conventional sealed blister package assemblies also include the fact that the adhesive or heat sealing process can adversely affect the product being packaged. The resulting blister package system can be complicated and difficult to assemble. These types of systems are primarily efficient in high-volume, manufacturing applications. There is a need for a less complicated blister package that includes a label or is otherwise operable to carry printed information.

Pharmacies have increasingly had a need to package medications, including mixed medications, at the pharmacy in a manner that encourages a patient to remember to take all of their medications at the proper interval. Whereas each medication was previously placed in a distinct vial, medication(s) may be placed in a pill box that is divided into compartments for each day. The patient accesses the pills in each individual box for each day. However, pill boxes often do not seal in a manner that ensures the freshness of the medication. Moreover, pill boxes often do not indicate when the box or medication has been tampered with. It is also time consuming to fill the individual boxes.

For this and other reasons, there is a need for a self-sealing blister package that may also be labeled and would provide evidence of tampering. The sealed blister assembly of the present invention is a new packaging option that satisfies this and/or other needs in the blister package or on-site pharmaceutical packaging industries.

SUMMARY OF THE INVENTION

The present invention addresses the above or other drawbacks and shortcomings of previously known blister packages. In accordance with the present invention, a sealed blister assembly is provided that does not require an adhesive or heat sealing process to seal a blister sheet and a lid sheet. The sealed blister assembly provides an impermeable, or substantially impermeable, seal. In addition, the present invention includes a label sheet for information and tamper-indication purposes. The label sheet is secured to both the blister and lid sheets.

The sealed blister assembly comprises either an individual blister pack or a plurality of blister packs. In one embodiment, the sealed blister assembly includes a blister sheet, lid sheet, and label sheet. The blister sheet has a recess formed therein, the recess having a perimeter all around an opening into the recess. The lid sheet is adapted to attach to or within the perimeter of the recess and cover the opening into the recess in a sealable manner. To form a plurality of blister packs, the blister sheet comprises more than one recess and a lid sheet comprises a corresponding number of engagement points adapted to attach to the recess or within the recess perimeter. Either way, a pharmaceutical medication or other product may be positioned in each recess to form one or more product-containing sealed blisters.

The label sheet is adhered or otherwise joined to the lid sheet opposite the blister sheet. The lid sheet is molded, or portions of the lid sheet are cut or removed, to expose the underlying blister sheet. The label sheet is adhered or otherwise joined to the blister sheet at these exposed points/openings. Even partially removing a lid from the blister sheet causes the label sheet to tear, which provides a level of tamper-indication. Indicia on the label sheet can carry patient information, product information, advertising, or the like.

As briefly stated above, each sealed blister in the sealed blister assembly may be an individual sealed blister or the assembly may comprise a plurality of sealed blisters. Where there is a plurality of sealed blisters, the label sheet, lid sheet, and blister sheet are all scored to allow one or more sealed blisters to be removed from the overall sealed blister assembly.

While the above highlights particular features of the invention in order that the detailed description thereof may be better understood, and in order that the present contribution to the art may be better appreciated, there are additional features of the invention that will be described hereinafter. Also, it is to be understood that the phraseology and terminology employed herein are for the purpose of the description and should not be regarded as limiting.

BRIEF DESCRIPTION OF THE DRAWINGS

The foregoing, and additional objects, features, and advantages of the present invention will become apparent to those of skill in the art from the following detailed description of a preferred embodiment thereof, taken in conjunction with the accompanying drawings, in which:

FIG. 4 is another perspective view thereof;

DETAILED DESCRIPTION OF PREFERRED EMBODIMENTS

A sealed blister assembly for use with providing a product in a blister pack in accordance with the present invention provides an improved apparatus and method for dispensing products from, and sealing products in a blister package. The sealed blister assembly comprises three layers: a blister sheet, a lid sheet, and a label sheet. The label sheet is secured to both the blister sheet and lid sheet. The label sheet is operable to provide a level of tamper indication. The label sheet is connected to the lid sheet, and the lid sheet is substantially sandwiched between the label and blister sheets. The label sheet may also be connected to the blister sheet via openings in the lid sheet that provide access to the blister sheet. The label sheet may also include printed indicia.

The lid sheet provides frictional engagement points with the blister sheet wherein the overlapping of the blister sheet with the lid sheet acts to seal recesses provided in the blister sheet. It is possible to simply press the lid sheet onto the blister sheet as they fit together in an overlying relationship. The label sheet can also be secured to the lid sheet by numerous mechanisms that would be obvious to one of skill in the art (adhesives, heat sealing, etc.).

The openings or access points in the lid sheet provide one means to allow a contact point between the label sheet and blister sheet. In addition, in one preferred embodiment, the blister sheet may also include protuberances or "bumps" on the face of the blister sheet that fit into the lid sheet openings/access points. Therefore, the label sheet may more easily be secured to the blister sheet. The protuberances are also thought to give the label sheet a more flat appearance as they fill the access points/openings provided by the lid sheet.

Figure 1:
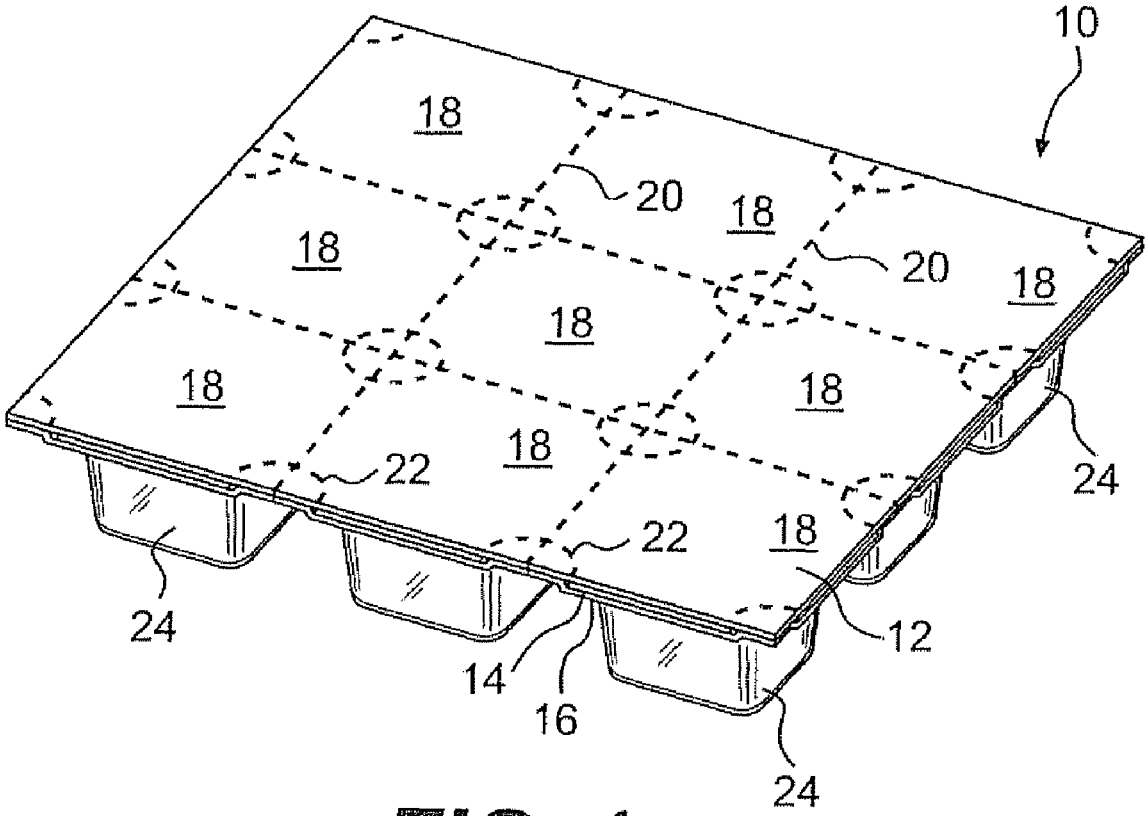
FIG. 1 is a perspective view of a sealed blister assembly with a plurality of sealed blisters, each blister comprising a blister sheet, a lid sheet, and a label sheet in accordance with one embodiment of the present invention.

Turning to FIG. 1, there is illustrated a sealed blister assembly 10 including a label sheet 12, lid sheet 14, and blister sheet 16. The label sheet is attached to the lid sheet. The lid sheet is sandwiched between the label and blister sheets. The lid sheet sealingly engages the blister sheet. As briefly described above, the label sheet is also screwed directly to the blister sheet.

The sealed blister assembly can comprise an individual blister pack 18 or a plurality of individual blister packs 18, as illustrated. Score lines 20, represented in the figures as broken lines, provide weakened points for a user or patient to remove an individual pack 18 or packs from the assembly 10. The linear score lines are provided through each of the three layers. In addition, there are illustrated label score lines 22 (shown as broken lines). The label score lines define a radius. Label score lines 22, although they need not be circular or curved, exist in label sheet 12 layer of the assembly only. In the embodiment illustrated in FIG. 1, the score lines define quarter circles at each corner of an individual, substantially rectilinearly shaped blister pack 18. Where the corner of a blister pack 18 meets the corners of three other blister packs 18 in sealed blister assembly 10, the label score lines 22 form a circle. Again, it is possible that the label score lines could form other shapes such as squares, rectangles, etc. The illustration of FIG. 1 illustrates just one envisioned embodiment.

Blister sheet 16 includes at least one recess 24. In use, lid sheet 14 is operable to engage the openings defined by each recess 24 in order to create a sealed blister pack. The seal is ideally frictionally formed. However, it is possible that a mechanism such as heat sealing or adhering could secure lid sheet 14 to blister sheet. As will also be explained further below, removing lid sheet 14 or otherwise opening a recess 24 previously sealed by lid sheet 14 will cause label sheet 12 to tear along label score lines 22. This provides a level of tamper-indication. Label sheet 12 may also include printed indicia (instructions, patient information, calendar information, advertisements, etc.).

Figure 1A:
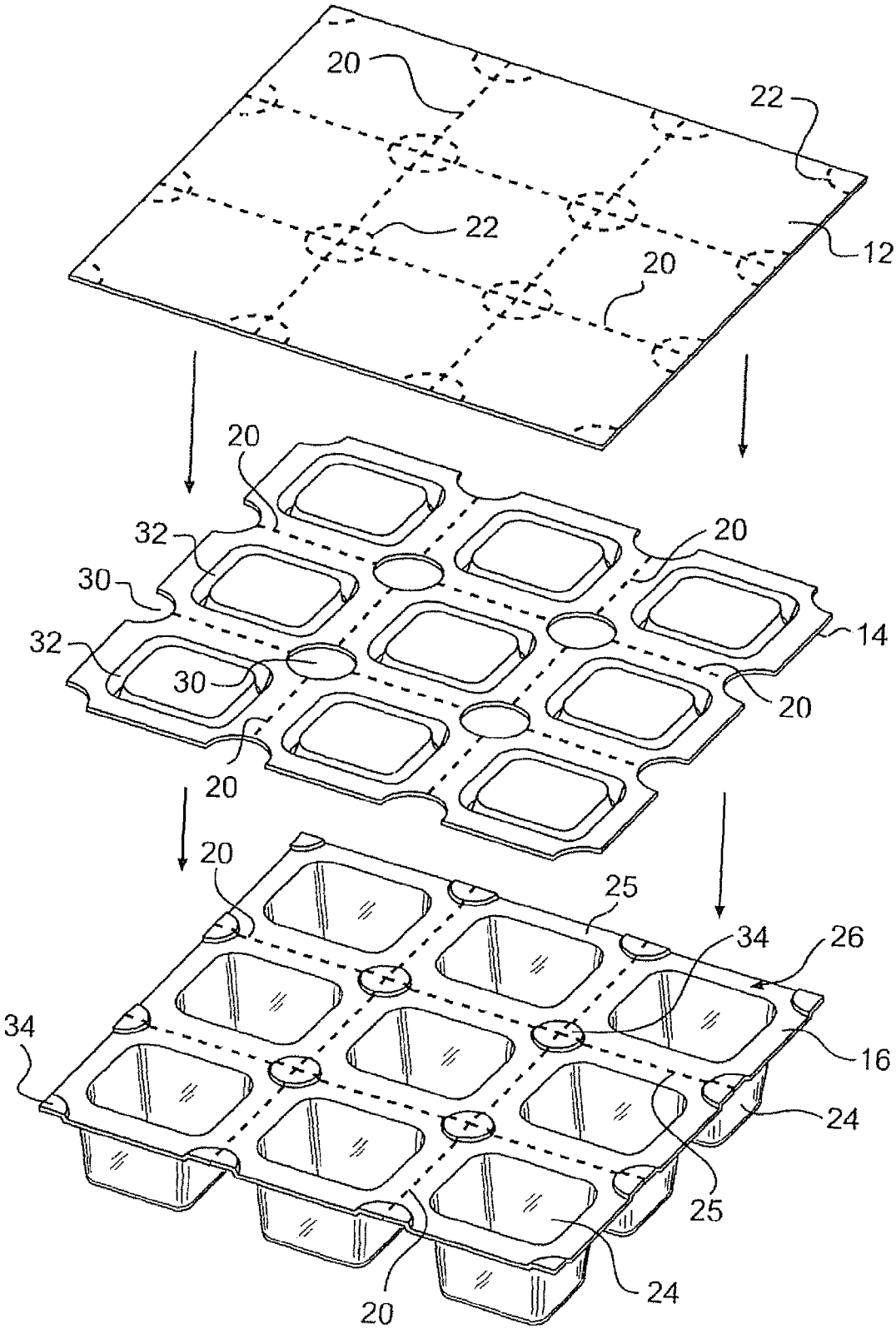

The components of sealed blister assembly 10 are more clearly illustrated by the exploded view in FIG. 1A. Blister sheet 16 and lid sheet 14 are in an overlying relationship. Blister sheet 16 has a plurality of blister recesses 24 formed therein. Blister recesses 24 are arranged in a pattern and are surrounded, and separated, by flat portions 25 of blister sheet 16. These flat portions define a face 26 of the blister sheet. Where a particular assembly 10 is intended for dispensing pharmaceutical medications, blister recesses 24 may be arranged in a matrix of rows and columns that correspond to a calendar or some other schedule convenient for a particular patient. For instance, assembly 10 may include rows of seven blister packs corresponding to the days of the week. Label 12 may then include indicia identifying the day corresponding to each pack 18. Customizable schedules or information on label sheet 12 correspond to a specific client, patient, medication, or item contained in assembly 10. Separable score lines 20 on lid sheet 14 and blister sheet 16 form preweakened areas that allow the individual blister assemblies 18 to be separated from each other.

Lid sheet 14 includes access points or openings 30 that correspond in placement, shape, and size to the label scored lines 22. As illustrated, the corners of assembly 101 openings 30 form quarter circles of material removed from label sheet 14. Along the edge of assembly 10, openings 30 form half circles as they abut an opening 30 of an adjacent pack 18. Openings 30, provided where the corners of four packs 18 meet in assembly 10, form a circle. Again, label score lines 20 may form other shapes. Therefore, openings 30 may take a different, corresponding forms as well.

Lid sheet 14 further includes a ridge 32 that faces towards blister sheet 16 and that corresponds in size and shape to the opening of each recess 24 provided by the blister sheet, as discussed further below. Generally, the ridges act as frictional engagement points to seal each recess 24 when lid sheet 14 is placed into an overlying relationship with blister sheet 16. However, ridges 32 are optional as they may be deleted if lid sheet 14 is adhered or otherwise fastened to blister sheet 16.

Examining now the blister sheet of FIGS. 1 and 1A in more detail, there is illustrated an embodiment where protuberances 34 raise above face 26 towards lid sheet 14. Protuberances 34 correspond in placement, shape, and size to access points or openings 30 in lid sheet 14. Therefore, they also correspond in placement and shape to label scored lines 22. In the embodiment of FIGS. 1 and 1A, these protuberances are secured to the label sheet by means of an adhesive, heat sealing, or the like via the access points 30. As the protuberances substantially fill openings 30, label sheet 12 is secured to assembly 10 in a "flat" manner. In an embodiment where protuberances are deleted, label sheet 12 would be joined to blister sheet 16 downwardly through lid sheet 14. Label sheet 12 would then provide a semi-convoluted surface that might make it difficult to read or appreciate any printed indicia on label sheet 12, were it to be included.

With or without protuberances 34, separating lid sheet 14 from blister sheet 16 causes label sheet 12 to tear along label score lines 22. The tearing indicates that a recess 24 has been opened and, therefore, provides a level of tamper indication to a patient.

Figure 2:
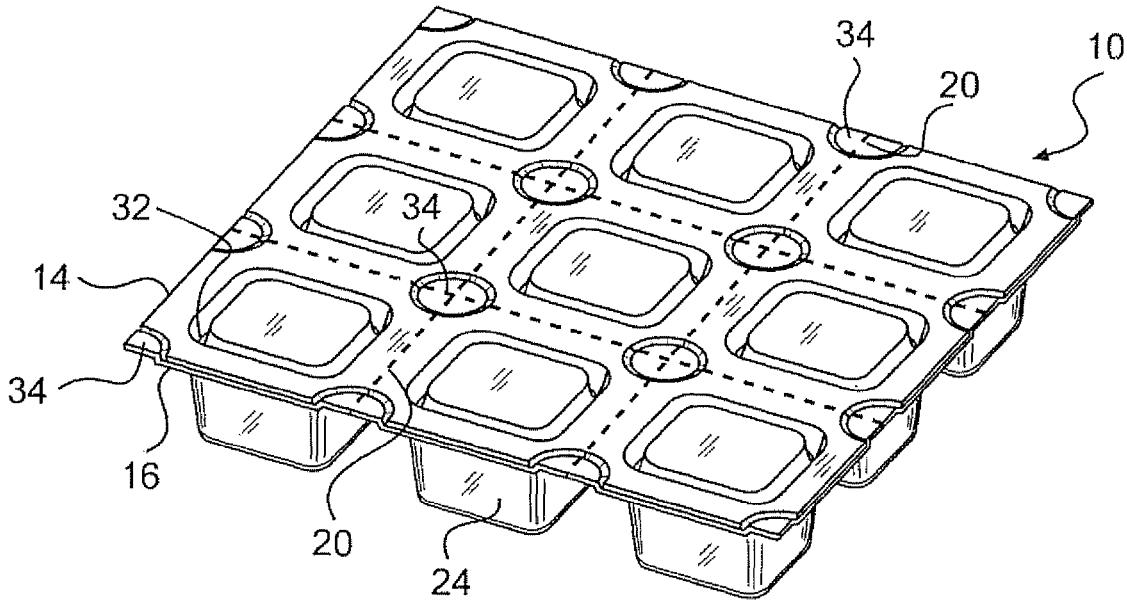
FIG. 2 is an exploded view thereof.
Figure 3:
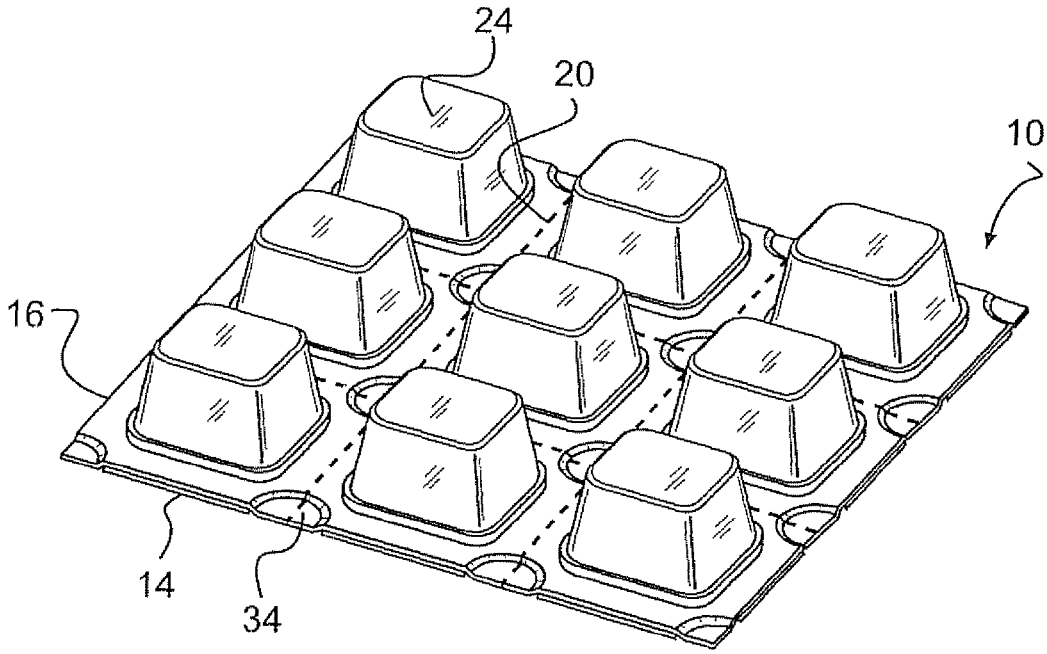
FIG. 3 is a perspective view of a sealed blister assembly with a plurality of sealed blisters, each blister comprising a blister sheet and a lid sheet.

FIGS. 2 and 3 provide illustrations of assembly 10 from perspectives above and below the assembly. Label sheet 12 has been removed. As illustrated, a ridge 32 is placed within the perimeter of each opening of each recess 24. The overlying relationship seals each recess 24.

FIGS. 4A-4D illustrate the cross sectional view of a single blister pack 18 from blister assembly 10. The figures illustrate lid sheet 14 sealed to the blister sheet 16 to close recess 24. This recess 24 is the blister into which medicines, food or other products can be packaged. Each recess 24 includes a perimeter 40 around the opening to the recess. The perimeter defines the opening of the recess. The perimeter wall 40 can be vertical or sloped positively or negatively relative to face 26 of blister sheet 16.

Figure 4B:
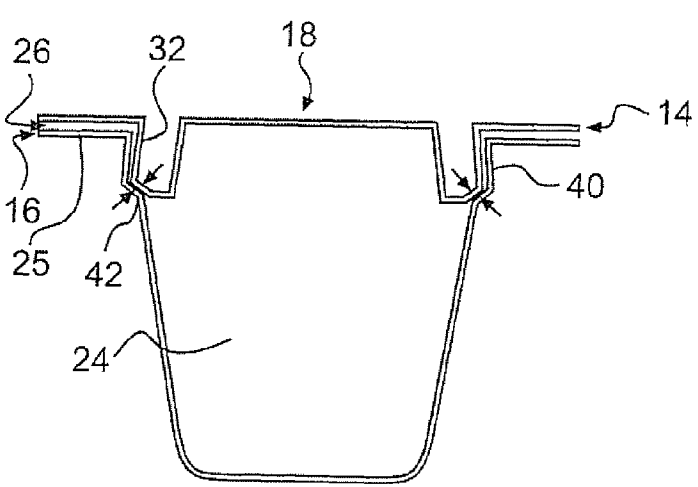
FIGS. 4A-4D illustrate various sealing arrangements between a lid sheet and a blister sheet in accordance with embodiment of the present invention.
Figure 4A:
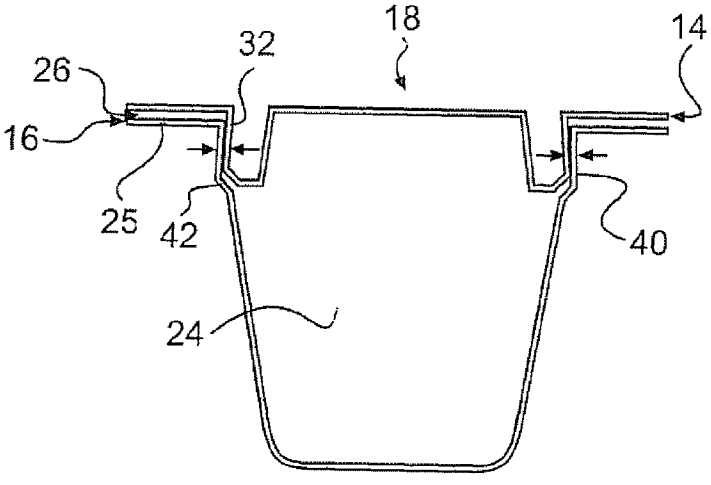

Examining FIG. 4A, perimeter 40 comprises a wall around the opening of the recess. The wall depends downwardly from face 26 and flat portion 25 and slightly outwardly from the opening of recess 24. An undercut 42 joins the slope of the perimeter wall to the slope of the recess walls (i.e., the undercut is not aligned with either the perimeter wall or recess wall). Lid ridge 32 includes an outside edge that flares outwardly marginally to ensure a frictional engagement between the perimeter wall and ridge wall. The sealed blister results from the engagement of the perimeter wall and ridge wall.

In the embodiment of FIG. 4B, perimeter 40 comprises near vertical sidewalls around the recess opening. The structure differs from FIG. 4A in that the seal is formed at the undercut 42 and a corresponding portion of ridge 32 that fits flush again undercut 42 when lid sheet 14 is overlaid onto blister sheet 16.

Figure 4D:
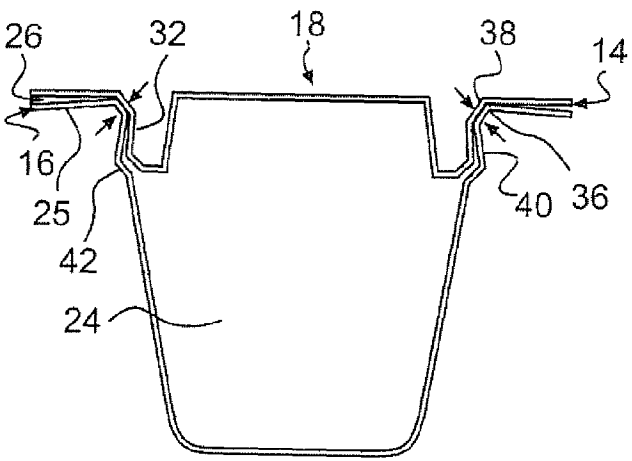
Figure 4C:
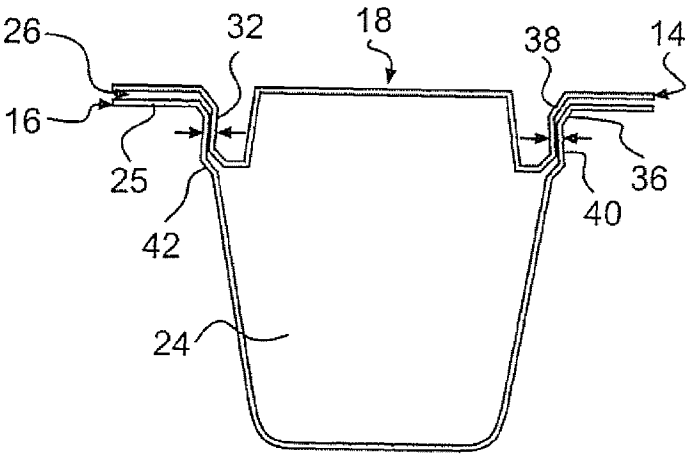

In FIG. 4C, perimeter wall 40 and ridge wall 32 both include a shoulder (elements 36 and 38 respectively). The shoulders join the respective walls to the flat portions of sheets 14 and 16. The sealed blister results from the engagement of the perimeter wall and ridge wall.

In FIG. 4D, another embodiment is illustrated where perimeter wall 40 flares outwardly from the opening of the recess. Like FIG. 4C, the ridge wall 32 and perimeter wall 40 include shoulders. The sealed blister results from the engagement of the perimeter wall shoulder and ridge wall shoulder.

The engagement between the lid sheet 14 and blister sheet 16 must be specifically engineered in order to be able to obtain a very tight fit between the respective components. In a preferred embodiment where an assembly is provided for dispensing pharmaceutical medications, the blister shape is approximately rectangular with rounded corners and the dimensions are approximately ¾"×⅞". The length and width dimensions of ridge 32 are slightly larger than the corresponding dimensions of perimeter 40 to better form the impermeable seal therebetween. In a preferred example the ridge 32 dimensions are 0.002" larger than the perimeter's dimensions.

Figure 5:
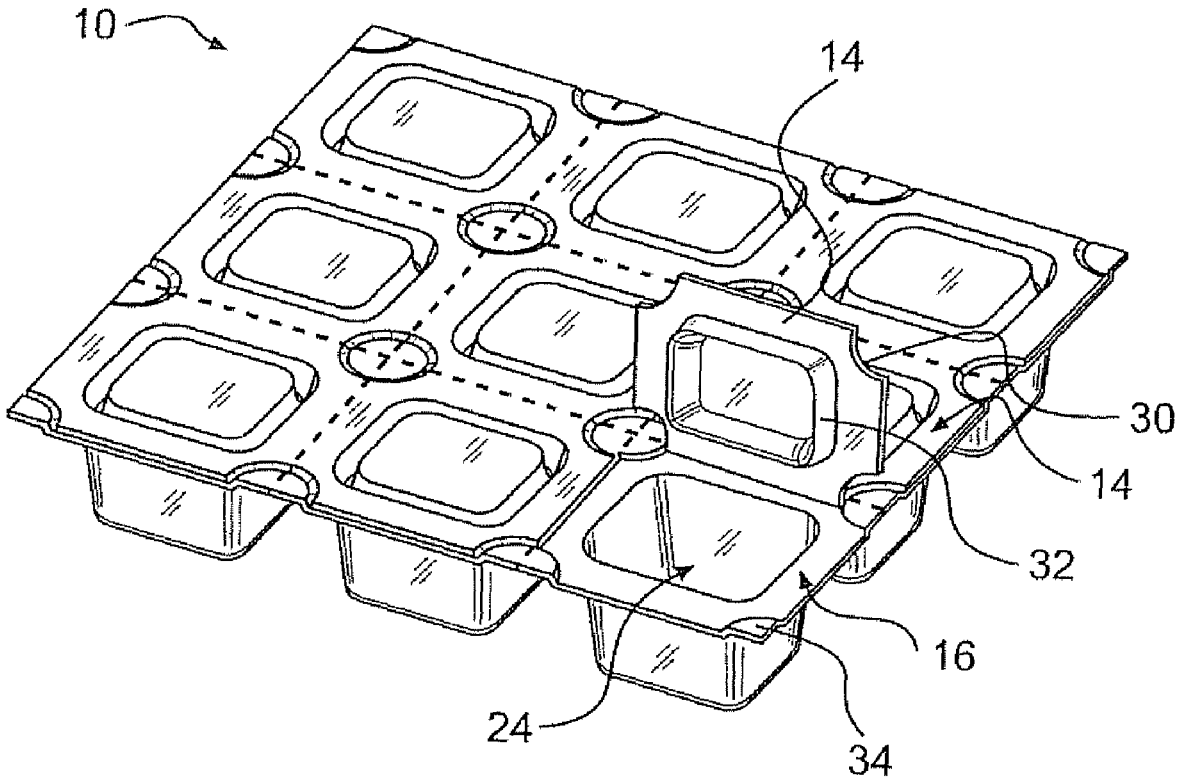
FIG. 5 is a perspective view of a partially opened blister pack.

FIG. 5 illustrates blister assembly 10 without label sheet 12 wherein an individual blister pack 18 is at least partially opened. The recess undercut is not illustrated in this figure. As one of skill in the art would appreciate, label sheet 12 (not illustrated here) will tear as lid sheet 14 is lifted from blister sheet 16. Portions of the label sheet are joined to protuberances 34. As the lid is lifted, the label sheet tears along label score lines 22.

Any suitable polymer or polymers can be used to make the lid and blister sheets of the assembly 10. The actual material used (polymer(s), metal, etc.) is a matter of selection for a given application. In an embodiment where assembly 10 is intended for medication, it is preferred that the lid and blister sheets include polyethylene, and specifically a low-density polyethylene. Low-density polyethylene has a "softness" that allows the plastic layer to seal as required. Most advantageously, both lid sheet 14 and blister sheet 16 are made from low-density polyethylene. Nevertheless, it is only required that the material have the ability to form an impermeable seal. Consequently, other materials may be used including, without limitation, other polyethylenes, polypropylenes, polystyrenes, polyesters, vinyls, and blends thereof. In order to obtain an impermeable seal to comply with different medication dispensing and food packaging applications, the plastic must have sufficient barrier properties to prevent air/vapor/liquid ingress and egress in the package assembly.

Accordingly, coextruded and laminated products may be used to combine the properties of two or more polymers. For instance, a low-density polyethylene may be an outside layer of a plastic sheet in order to achieve a desirable seal. However, a layer of barrier material, for instance, EVOH, may be laminated onto the polyethylene or sandwiched between layers of polyethylene to obtain a superior impermeable layer. In another example, a stiff plastic, such as polyester, may be used to provide a certain desirable stiffness for the assembly. The polyethylene and/or a barrier layer could be coextruded with or laminated onto the polyester layer. The thickness of the polymer is again the choice of the packaging engineer. In the specific example of a medication packaging assembly, the polyethylene layer is 0.001 inches thick and is laminated onto a base film of a vinyl or polyester.

It is desirable for label sheet 12 to include printed indicia. Label sheet 12 might be formed from paper, cardboard, or other materials. It is possible to have a printable polymer or coextruded material as label sheet 12. The printing may also be achieved by engraving of indicia "Printed indicia" herein more generally means any indicia added to the material of label sheet 12 to convey information, images, or the like. The specific technology for adding printed indicia would be known to one of skill in the relevant art.

Figure 6:
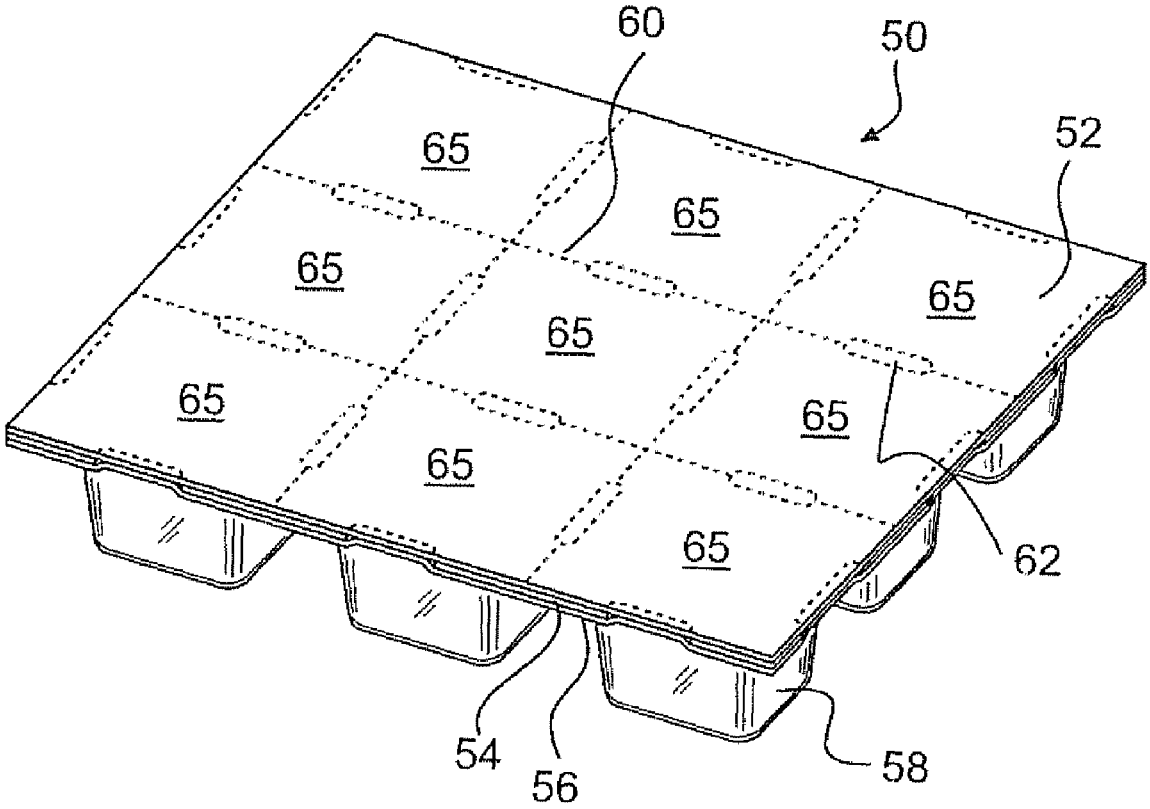
FIG. 6 is a perspective view of one alternative embodiment of the sealed blister assembly wherein the sealed blister assembly includes a plurality of sealed blisters, each blister comprising a blister sheet, a lid sheet, and a label sheet.
Figure 7:
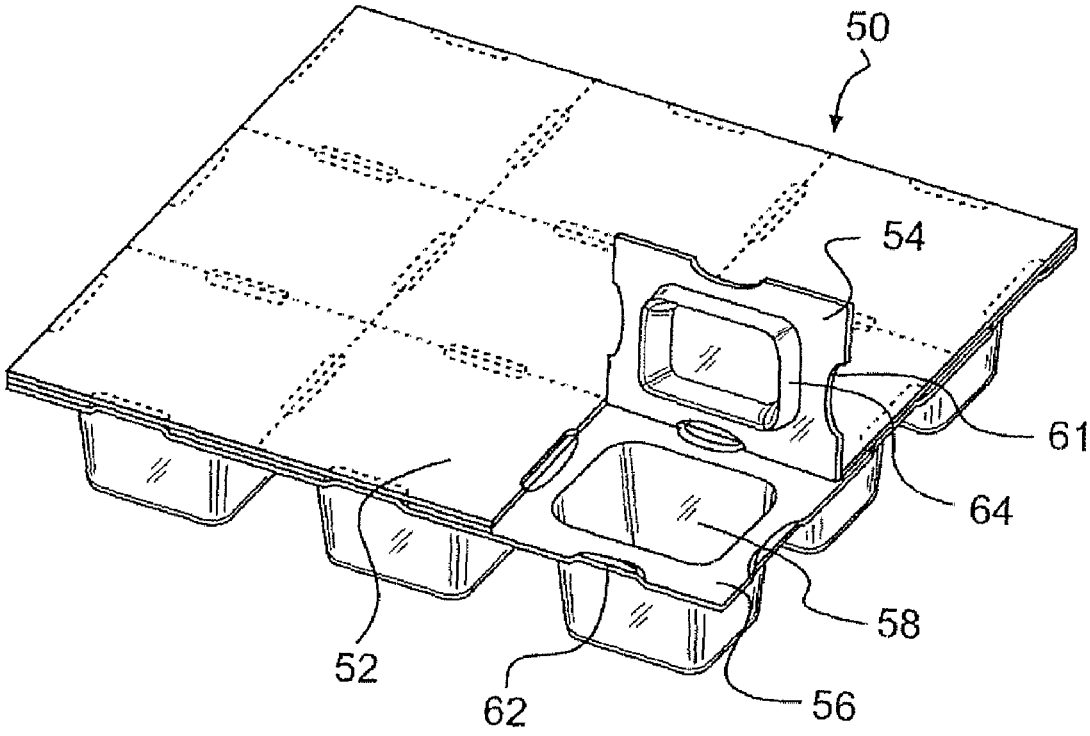
FIG. 7 is a perspective view thereof with one partially opened blister pack.

FIGS. 6 and 7 illustrate an alternative embodiment. Sealed blister assembly 50 includes a label sheet 52, a lid sheet 54, and a blister sheet 56. The label sheet 52 is attached to the lid sheet 54. The lid sheet 54 is sandwiched between the label sheet 52 and the blister sheet 56. The label sheet 52 is also attached to the blister sheet 56. The sealed blister assembly 50 can comprise an individual blister pack 65 or a plurality of individual blister packs 65 as shown. Score lines 60, represented in the figures as broken lines, provide weakened points for a user or patient to remove an individual pack 65 or packs from the assembly 50. In addition, there are illustrated label score lines 62 (shown as broken lines). The label score lines 62 define an oval or racetrack shape. As indicated earlier, it is possible for the label score lines to form other shapes, such as squares, rectangles, circles, etc.

FIG. 7 illustrates blister assembly 50 wherein an individual blister pack 65 is at least partially opened. The recess undercut is not illustrated in this figure. Label sheet 52 tears as lid sheet 54 is lifted from blister sheet 56. Portions of the label sheet 52 are joined to protuberances 62. As the lid 54 is lifted, the label sheet 52 tears along score lines 60 and label score lines 62. In the view of FIG. 7, the ridge 64 of the lid sheet 54 is seen. Also, openings 61 defined by the lid sheet 54 are shown. The protuberances 62 correspond to and are adapted to fit into the openings 61 defined by the lid sheet 54.

Each of the examples of the present invention discussed herein include openings in the lid sheet along each sidewall of a blister package or at each corner of a blister package. Of course, the openings in a lid sheet may be strategically engineered to only be placed at one corner or along one sidewall of a sealed blister assembly. Alternatively, another example might include an opening in two or three corners or two or three sidewalls of a lid sheet for a blister package. Other variations in placement of the openings (and the corresponding protuberances and label score lines) are possible.

In one preferred embodiment, assembly 10 is operable as a medication dispensing assembly. Pharmaceutical medications may mean pills, capsules, tablets, liquid medicines, etc. There are innumerous other applications such as food packaging or liquid packaging that could be used in connection with the present invention.

Permeation guidelines for containers are disclosed and defined in USP 24 [671 Containers—Permeation], page 1936. A blister pack in accordance with any one of the above embodiments, and specifically a blister pack comprising a multi-layer film of polyethylene (1.5 mils) and PET (15 mils), is predicted to be a U.S.P. Class B container. Under test Method II, a blister pack as described above will have an average moisture permeability rate of less than 5 mg/day.

While the invention has been described with reference to specific embodiments thereof, it will be understood that numerous variations, modifications and additional embodiments are possible, and accordingly, all such variations, modifications, and embodiments are to be regarded as being within the spirit and scope of the invention.

What is claimed is:

1. A sealed blister assembly comprising:

a blister sheet having a recess and face formed therein, the recess having a perimeter all around an opening into the recess;

a lid sheet engaging the perimeter of the recess and cover the opening into the recess, the lid sheet comprising an access point in the form of an aperture, the access points exposing the face of the underlying blister sheet, wherein the engagement between the lid sheet and recess perimeter forms an impermeably sealed blister;

the blister sheet further comprising a protuberance located in the face of the blister sheet and raised away from the face opposite the recess, the protuberance corresponding in shape and size to the access point;

wherein the protuberance substantially fills the access point when the blister sheet and lid sheet are sealed together; and a label sheet secured to the lid sheet on the opposite side of the lid sheet from the blister sheet and the label sheet further secured to the protuberance of the blister sheet via the access point so that the label sheet is secured in a flat manner.

2. The sealed blister assembly described in claim 1, the blister sheet further comprising a plurality of recesses and respective flat portions and protuberances on the face of the blister sheet, the lid sheet further comprising a plurality of engagement points corresponding to the plurality of recesses and access points corresponding to the protuberances, the engagement of the lid sheet and blister sheet forming a plurality of impermeably sealed blisters; and wherein the sealed blister assembly is scored to provide for the removal of individual sealed blister packs from the sealed blister assembly.

3. The sealed blister assembly described in claim 1, the recess perimeter further comprising a wall and an undercut connecting the perimeter wall to the recess, the lid sheet further comprising a raised ridge having an outside wall adapted to engage the perimeter wall, and wherein the ridge wall flares outwardly, the sealed blister resulting from the engagement of the perimeter wall and ridge wall.

4. The sealed blister assembly described in claim 1, wherein the recess and the recess perimeter provide sidewalls and further comprising an undercut connecting the recess and perimeter sidewalls, the lid sheet further comprising a raised ridge, the raised ridge adapted to fit flush against the recess undercut; and wherein the sealed blister results from the engagement between the perimeter undercut and ridge.

5. The sealed blister assembly described in claim 1, the recess perimeter further comprising a wall about the opening of the recess, an undercut, and a shoulder portion connecting the perimeter wall to a flat portion of the blister sheet;

the lid sheet further comprising a raised ridge having an outside edge adapted to engage the perimeter wall around the perimeter, and wherein the outside edge of the ridge comprises walls that flare outwardly, the sealed blister resulting from the engagement of the undercut sidewalls and flared ridge walls.

6. The sealed blister assembly described in claim 1, further comprising a perimeter shoulder, the shoulder connecting the recess perimeter to the blister sheet, the lid sheet further comprising a raised ridge and a lid shoulder connecting the raised ridge to the lid sheet; and wherein the sealed blister results from the engagement of the perimeter shoulders and lid shoulders.

7. The sealed blister assembly described in claim 1, further wherein the sealed blister assembly is used for packaging a medication and the sealed blister assembly has an average moisture permeability rate of less than 5 mg/day.

8. The sealed blister assembly described in claim 1, wherein separating the lid sheet from the blister sheet tears the label sheet.

9. The sealed blister assembly described in claim 1, the label sheet further including printed indicia.

* * * * *